United States Patent [19]

McMahon

[11] Patent Number: 4,993,585

[45] Date of Patent: Feb. 19, 1991

[54] ENCAPSULATED CASE EDGING

[76] Inventor: William McMahon, 10610 Lakeside Dr. N. #G, Garden Grove, Calif. 92640

[21] Appl. No.: 557,726

[22] Filed: Jul. 26, 1990

Related U.S. Application Data

[63] Continuation-in-part of Ser. No. 296,014, Jan. 12, 1989, abandoned.

[51] Int. Cl.[5] ..... B65D 1/48; B65D 6/34

[52] U.S. Cl. ..... 220/643; 220/422

[58] Field of Search ..... 220/640, 641, 642, 643, 220/644, 645; 10/122, 127

[56] References Cited

U.S. PATENT DOCUMENTS

| | | | |
|---|---|---|---|
| 1,537,600 | 5/1925 | Grogan | 220/642 |
| 2,510,643 | 6/1950 | Long | 190/127 |
| 2,969,891 | 1/1961 | Presnick | 220/640 |
| 3,088,623 | 5/1963 | Parker | 220/643 |
| 3,513,951 | 5/1970 | Leong | 190/122 |
| 4,079,851 | 3/1978 | Valyi | 220/643 |
| 4,095,719 | 6/1978 | Wolf | 220/640 |
| 4,284,202 | 8/1981 | Barstow | 220/644 |

FOREIGN PATENT DOCUMENTS

| | | | |
|---|---|---|---|
| 1068453 | 5/1967 | United Kingdom | 190/122 |
| 1403092 | 8/1975 | United Kingdom | 190/122 |

*Primary Examiner*—George E. Lowrance
*Attorney, Agent, or Firm*—Albert O. Cota

[57] ABSTRACT

A thermoplastic case which has an interlocking bottom peripheral edging (20) with a lobe (26) on the outside surface to which a vacuum formed bottom (28) has been conformed completely enveloping the lobe creating a structural bond for fastening the two parts together. A lid edging (30) and case lid (38) are formed in the same manner completing the case. A resilient cord (46) may be added to assure the seal between the edgings and a bonding agent in the form of cement (50) or tape (52) may be employed to complete a hermetic seal for the case. Webbing (56) may optionally be added formed integrally with the edging for suspending articles within the case.

15 Claims, 2 Drawing Sheets

ENCAPSULATED CASE EDGING

This application is a continuation-in-part of application Ser. No. 07/296,014 filed 01/12/89, now abandoned.

TECHNICAL FIELD

The present invention relates to edging for cases that carry and store articles in general and more specifically to vacuum formed cases with an edging between the bottom and the lid that is attached with encapsulation of the case material during vacuum forming.

BACKGROUND ART

Previously many types of edging have been used in endeavoring to provide an effective means of joining the sealing member of the bottom half of a case to the top half or lid. The attachment of this edging member to the case, particularly the vacuum formed type, has been accomplished using fasteners, bonding with adhesive, captivating between contiguous appendages or even forming the edging as an integral part of the case.

A search of the prior art did not disclose any patents that read directly on the claims of the instant invention however, the following U.S. patents were considered:

| PAT. NO. | INVENTOR | ISSUED |
|---|---|---|
| 4,284,202 | Barstow, Jr. | 18 August 1981 |
| 4,095,719 | Wolf | 20 January 1978 |
| 3,513,951 | Leong, et al | 26 May 1970 |
| 3,088,623 | Parker | 7 May 1963 |
| 2,969,891 | Presnick | 31 January 1961 |
| 2,510,643 | Long | 6 June 1950 |
| also Great Britain | | |
| 1,403,092 | Roper Corp. | 13 August 1975 |
| 1,068,453 | Schmid | 10 May 1967 |

In the patent No. 4,284,202 issued to Barstow, Jr. a container is disclosed that uses a base and lid joined together with a tongue and groove arrangement. The base and lid include integrally formed interlocking portions without the use of separate case edging.

Wolf uses an edge extrusion attached on the peripheral rim and to the sidewall the shell of a plastic container the edge extrusion includes a rubber gasket. The top and bottom of the case are inserted into grooves in the extrusion and crimped in place. The internal groove contains a plurality of ridges helping to secure the case after it is crimped.

Leong, et al teach a vacuum formed luggage case and a protecting frame or valance strip secured by crimping about the perimeter of each shell. The frame contains a channel and the shell edge portion within the channel is at a substantial angle approaching right angular relationship providing strength and stability.

Parker employs the same channel like structure of extruded metal except with complimentary sealing devices arranged to be held in contacting relationship with each other to form a seal. The walls of the case are bonded and a resilient pressure strip is integrally exerting outward pressure on the sides assisting to hold them in place along with the bonding.

Presnick in U.S. Pat. No. 2,969,811 attaches a peripheral molding strip using bonding resins deposited in a cavity between the case wall and molding in combination with circumferential welding. The heat of the fusion welding does not affect the resin as it is contained within the cavity away from the point of heat concentration.

Schmid in patent No. 1,068,453 issued in Great Britain utilizes a metal profile frame around a box. The frames have flanges on their inner side with saw toothed serrations which hook into the rims, which may be leather or the like. Also the rims are folded over their edge by rolling deforming the metal into a gripping profile engaging the body of the box.

For background purposes and as indicative of the art to which the invention relates, reference may be made to the remaining cited patents issued to Long and Roper Corporation.

It may be clearly seen that prior art fully realizes the problem of attachment of a separate edging to some type of case however, encapsulating the case body during the vacuum forming process is entirely new and unique.

DISCLOSURE OF THE INVENTION

Edging used to join halves of boxes and cases has been used for sometime, further since the advent of vacuum forming the problem of attachment has become more acute. Attachment by crimping or fasteners is difficult and labor intensive particularly with thermoplastic or metal extrusions. In many cases accurate hand trimming is required when the bottom or lid is formed which requires considerable chill and includes wasted material.

It is therefore the primary object of the invention to employ an attachment that joins a thermoplastic case body to an extruded edging by integrally folding over a portion of the edging during the vacuum forming process eliminating completely alignment problems with the edging and unnecessary hand fitting.

An important object of the invention eliminates a complete step in the production of a case as the edging is formed in the perpherical shape and the bottom or lid thermoplastic material is heated and drawn over a mold under vacuum conforming exactly to the shape of the mold and the edging simultaneously. A lobe is included in the shape of the edging allowing encapsulation on three sides creating an integral bond between the parts holding the edging tightly in place.

Another object of the invention allows a hermetic seal to be easily incorporated in the process. A coating of sealing cement is applied to the edging and when the case is formed under heat and pressure, a permanent hermetic bond is made between the two elements. Further a ribbon or tape of adhesive may be used as a bonding agent with equal ease and utility. The addition of a resilient cord particularly in the form of an endless o-ring between male and female interlocking members integrally shaped into the edging further assures the integrity a true hermetic seal.

Still another object of the invention is directed to the strength of the joint between the case and the edging. Tests have been conducted that resulted in a joint having 95% of the strength of the parent material. This testing was directed to a pair of joints in a cylinder, and by comparison prior art, using the crimped method obtained, only 35% of the original materials strength in this comparative test procedure.

Yet another object of the invention allows webbing, straps, blankets, membranes and tags to be captured in the joint during reverse form encapsulation of the case edging. Again this procedure eliminates labor as this function may be accomplished during the vacuum forming with no separate method of attachment required.

These and other object and advantages of the present invention will become apparent from the subsequent detailed description of the preferred embodiment and the claims taken in conjunction with the accompanying drawings.

BEST MODE FOR CARRYING OUT THE INVENTION

Figure 1:
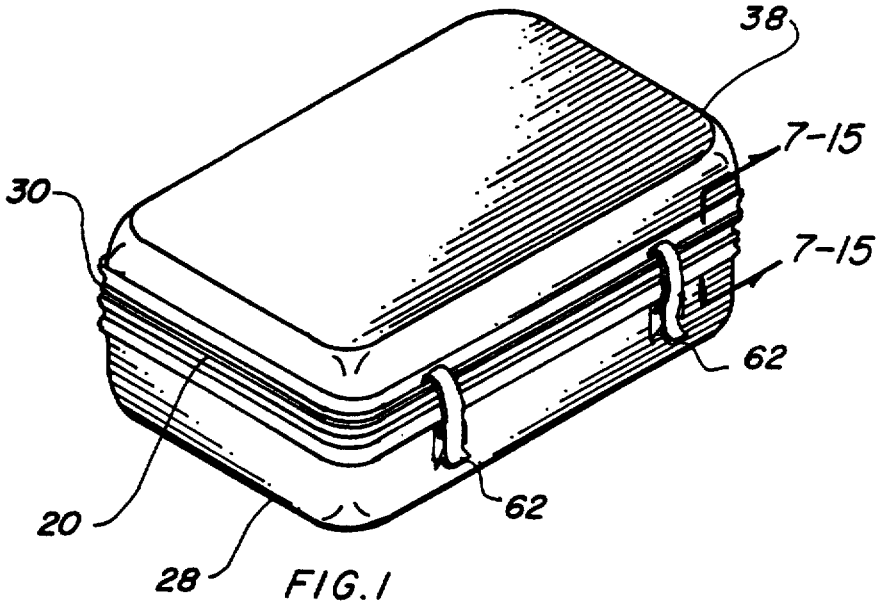
FIG. 1 is a partial isometric view of the preferred embodiment illustrated as a rectangular case in the closed condition.

The best mode for carrying out the invention is presented in terms of a preferred embodiment. The preferred embodiment, as shown in FIGS. 1 through 15 is comprised of an interlocking bottom peripheral edging 20 illustrated best in FIGS. 9-13. This edging 20 is configured with an inside surface 22 and an outside surface 24 with the outside surface having a downwardly projecting finger like lobe 26. The novelty of the invention is in the relationship of the vacuum formed case bottom 28 that intimately embraces the outside surface of the bottom edging 20 completely enveloping the lobe 26 forming a structural bond therebetween. Without this lobe 26, the case bottom 28 would simply form to the configuration of the mold and the outside surface 24 of the edging 20 requiring further attachment of some sort, as an example, in prior art, the case bottom 28 would be formed separately with mechanical attachment made later by crimping or riveting etc. It can clearly be seen that when the case is vacuum formed and the edging 20 is performed to the final shape of the case, the parent material of the case bottom 28 is drawn by negative pressure into the entire outside surface 24 of the edging 20 folding over the lobe 26 completely interlocking the two elements together.

Figures 5, 6, 7, 8, 9, 10, 11, 12, 13, 14, 15:
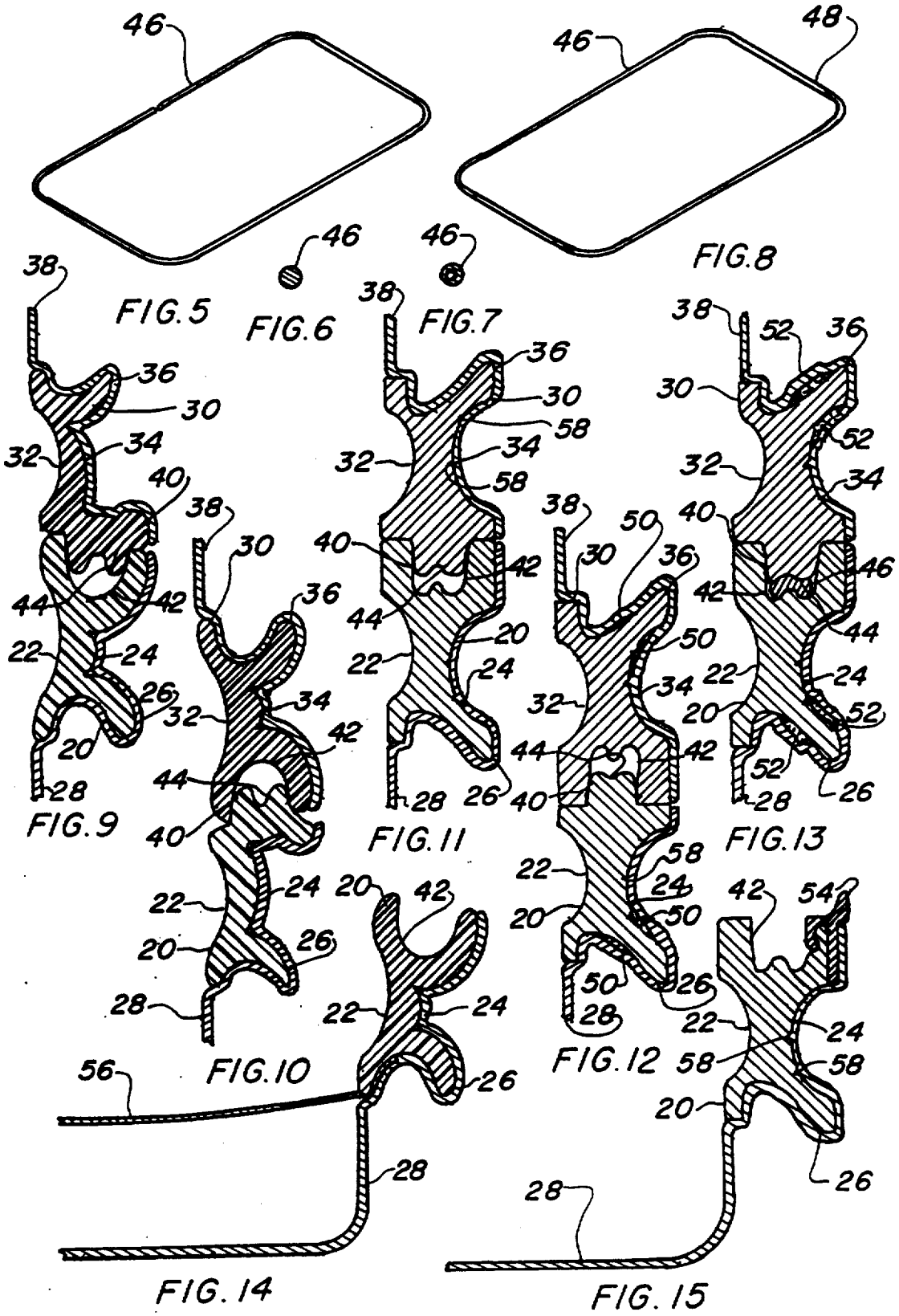
FIG. 5 is a partial isometric view of the cord with the ends butted.
FIG. 6 is a cross-sectional view taken along lines 6—6 of FIG. 5 illustrating a solid configuration.
FIG. 7 is a cross-sectional view taken along lines 7—7 of FIG. 5 illustrating a hallow configuration.
FIG. 8 is a partial isometric view of the cord in an o-ring configuration.
FIG. 9 is a cross-sectional view taken along lines 9—9 of FIG. 1 illustrating the edging in a thermoplastic configuration with the female interface on the bottom.
FIG. 10 is a cross-sectional view taken along lines 10—10 of FIG. 1 illustrating the edging in a thermoplastic configuration with the male interface on the bottom.
FIG. 11 is a cross-sectional view taken along lines 11—11 of FIG. 1 illustrating the edging in a metal configuration with the female interface on the bottom.
FIG. 12 is a cross-sectional view taken along lines 12—12 of FIG. 1 illustrating the edging in a metal configuration with the male interface on the bottom.
FIG. 13 is a cross-sectional view taken along lines 13—13 of FIG. 1 illustrating the edging in a metal configuration with the female interface on the bottom and the o-ring in place.
FIG. 14 is a cross-sectional view taken along lines 14—14 of FIG. 1 illustrating the case bottom only with webbing positioned in the edging.
FIG. 15 is a cross-sectional view taken along lines 15—15 of FIG. 1 illustrating the case bottom only with decorative trim positioned integrally with the edging.

A lid peripheral edging 30 also has an inside surface 32 and an outside surface 34 with an upwardly projecting finger-like lobe 36 on the outside surface the same as the bottom edging 20 except it is reversed being directly on top. The case lid 38 is almost in the same configuration as the bottom 28 again just reversed upside down on the top. The bottom 28 and lid 38 interlocked together by virtue of the shape of the edging with a tongue and groove like male interface 40 in conjunction with an opposed female interface 42 illustrated best in FIGS. 9-13. FIG. 9 depicts the female interface 42 on the bottom of the case 28 and the male interface 40 on the top. The conformal shape is slightly smaller for the male or larger for the female allowing a tight and accurate fit also the joint is inwardly tapered on the male end providing self centering of the joint. The interface joint may be reversed if desired with equal ease as FIG. 9 illustrates the male on the top and FIG. 10 the opposite. A notch 44 may also be included in the end of the male interface 40 to aid in the sealing of the elements.

Figure 2:
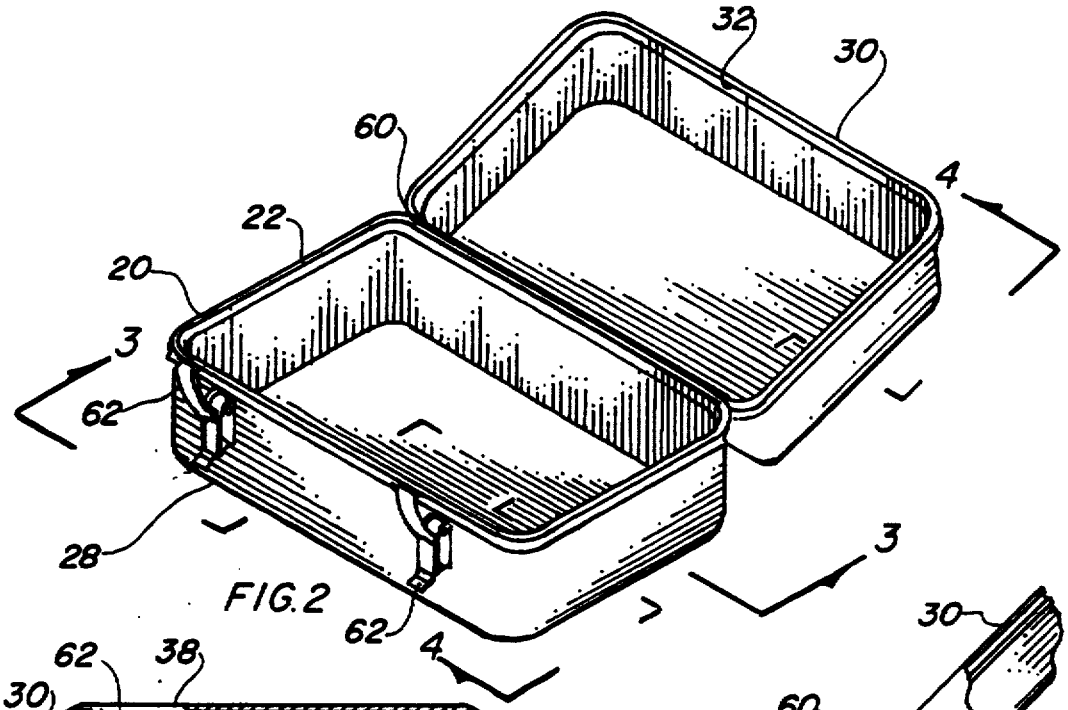
FIG. 2 is a partial isometric view of the preferred embodiment illustrated as a rectangular case in the open condition.
Figure 3:
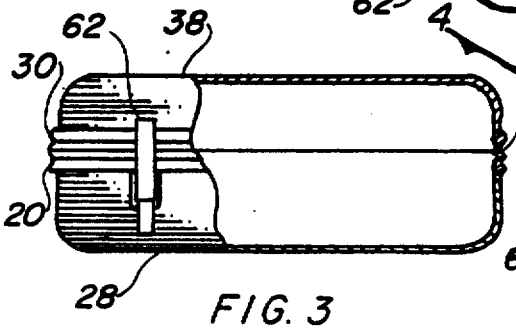
FIG. 3 is a cross-sectional view taken along lines 3—3 of FIG. 1 illustrating the longitudinal section.
Figure 4:
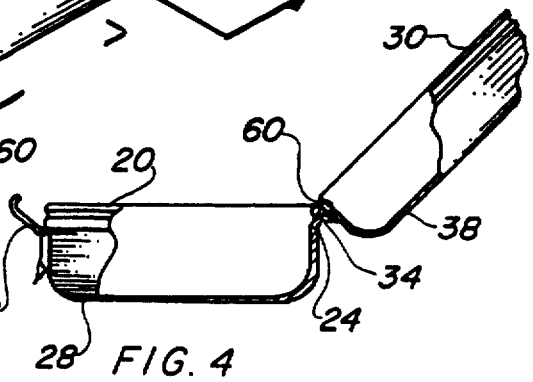
FIG. 4 is a cross-sectional view taken along lines 4—4 of FIG. 2 illustrating the open configuration section.

Any material having the structural integrity and formability may be used for the edgings 20 and 30, however, thermoplastic or metal is preferred. A myriad of thermoplastics may be used such as ABS, nylon polycarbonate, acrylic, polyvinyl chloride and the like with aluminum in an extruded form being preferred for the metal. The edging 20 and 30 is performed to the peripheral shape of the case such as radiused corners on a rectangular configuration as illustrated in FIGS. 1 and 2. The metal is normally cold formed however, the thermoplastic may be heated for forming where necessary. Extrusion is the preferred method of construction of the base edging in its original form due to its controlled configuration and cost effectiveness.

In order to provide an adequate seal for the case, the edgings 20 and 30 must be contiguously secure where they interface. A resilient cord 46 may be used for this purpose between the bottom edging 20 and the lid edging 30 with an easy method simply butting the ends together as shown in FIG. 5. This type of joint is normally sufficient, however, if a true hermetic seal is required a continuous or so called o-ring 48 may be employed as illustrated in FIG. 8 which is endless therefore completely surrounding the entire joint. This cord 46 in either configuration may be solid as shown in FIG. 6 or hollow as depicted in FIG. 7 as long a sit is resilient and has a memory filling the gap repeatably when the case is opened and closed. A closed cell sponge is the preferred material as it possesses the required functional characteristics and is readily available.

For a complete hermetic seal of the case not only do the edgings 20 and 30 require a positive seal where they interface with each other, but the bottom 28 and lid 38 parent material must have a complete air tight union also. This seal is accomplished using a bonding agent in the form of a cement 50 or meltable adhesive tape 52. The cement 50 may be any suitable composition that may be coated to the edgings 20 and 30 and activates or cures under heat during vacuum forming. The commercial cement CYCLOWELD has proven successful in the invention for accomplishing this task. FIG. 12 illustrates the cement 50 on an aluminum extruded edging and FIG. 13 depicts the tape which creates the hermetic seal when subjected to both heat and pressure during the forming process.

A decorative trim illustrated in FIG. 15 may be added to the assembly either on the bottom or lid as desired or even both if fancied, however, this element is not necessary for the invention but adds to its appearance and aesthetics.

FIG. 14 shows another feature of the edging allowing webbing 56 or other similar material to be encapsulated in the bottom or top edging 20 or 30 forming a weight bearing structure for holding articles within the case. This procedure is also conducted during the forming process and is held in place by the fixture when the heated plaster is placed over the mold and the material is drawn to the mold and accompanying edging when evacuated. Single tags or straps may also be encapsulated in this manner.

In order to obtain a tight fit and to assist in the forming process, a plurality of vacuum channels 58 may be added to the outside surfaces 24 and 34 of the edging. This void is particularly useful in the extruded aluminum embodiment and is easily accommodated in the fabrication of the die.

The case is shown as a rectangle in FIG. 1–4 however, this invention is not limited to any shape as square, oval, elliptical, round or any irregular shape may be used with equal ease. Accessories may be added such as hinges 60 and pull fasteners 62 as shown in FIGS. 1 and 2 or handles, locks, etc. may also be added all of which are well known in the art.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A thermoplastic case with a bottom and lid for carrying and storing articles comprising:

(a) an interlocking bottom peripheral edging with an inside surface and an outside surface having a downwardly projecting finger-like lobe on the outside surface, (b) a vacuum formed case bottom intimately embracing the outside surface of the bottom edging with the downwardly projecting lobe completely enveloped, creating an integral structural bond therebetween, (c) an interlocking lid peripheral edging with an inside surface and an outside surface having an upwardly projecting finger-like lobe on the outside surface with the lid edging interfacingly engaging the bottom edging, and (d) a vacuum formed case lid intimately embracing the outside surface of the lid edging with the upwardly projecting lobe completely enveloped, creating an integral structural bond therebetween allowing both edgings to attached to the case without the use of structural fasteners.

2. The case as recited in claim 1 further comprising said bottom edging having a female interface and said lid edging having a male interface for interlocking therebetween.

3. The case as recited in claim 1 further comprising said bottom edging having a male interface and said lid edging having a female interface for interlocking therebetween.

4. The base as recited in claim 1 wherein said bottom and lid edging are formed of extruded thermoplastic.

5. The case as recited in claim 1 wherein said bottom and lid edging are formed of extruded metal.

6. The case as recited in claim 1 further comprising a resilient cord disposed between the bottom edging and the lid edging forming a seal therebetween.

7. The case as recited in claim 6 wherein the cord further comprises a first end and a second end with the ends butted together forming a joint for maintaining the integrity of the seal.

8. The case as recited in claim 6 wherein the cord further comprises an o-ring having no terminating ends for creating a hermetic seal between the edgings of the case.

9. The case as recited in claim 6 wherein the cord is a closed cell sponge.

10. The case as recited in claim 1 further comprising a bonding agent between the case bottom and bottom edging also the case lid and lid edging for assuring a conformed bond therebetween.

11. The case as recited in claim 10 wherein the bonding agent further comprises a cement of a composition compatible in formulation with the case bottom and lid and the respective edgings.

12. The case as recited in claim 10 wherein the bonding agent further comprises a meltable adhesive tape of a composition compatible in formulation with the case bottom and lid and the respective edging such that the tape melts and adheres under heat and pressure.

13. The case as recited in claim 1 further comprising a decorative trim intimately juxtapositioned with the bottom edging form a peripheral decoration on the case.

14. The case as recited in claim 1 further comprising webbing positioned between the case bottom and the bottom edging forming a structure for suspending articles thereupon within the case.

15. The case as recited in claim 1 wherein said edging's further comprise a plurality of vacuum channels within an exterior surface of the edging for creating a tight mechanical bond between the edging and the case and assist in air removal during vacuum forming procedures.

* * * * *